US006227095B1

(12) United States Patent
Woodall et al.

(10) Patent No.: US 6,227,095 B1
(45) **Date of Patent: *May 8, 2001**

(54) INSENSITIVE MUNITION BOOSTER SEAL

(75) Inventors: Robert Woodall, Lynn Haven; Felipe Garcia, Panama City; Gilberto Irizarry, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/288,084

(22) Filed: Apr. 9, 1999

Related U.S. Application Data

(63) Continuation-in-part of application No. 09/012,932, filed on Jan. 24, 1998, and a continuation-in-part of application No. 08/944,049, filed on Sep. 12, 1997, now Pat. No. 5,932,835, and a continuation-in-part of application No. 09/030,518, filed on Feb. 23, 1998, now abandoned, and a continuation-in-part of application No. 09/034,772, filed on Mar. 2, 1998, now abandoned, and a continuation-in-part of application No. 09/146,918, filed on Aug. 31, 1998.

(51) Int. Cl.[7] ..... B63G 7/02

(52) U.S. Cl. ..... 89/1.13; 102/403; 102/482; 102/487; 102/318; 29/1.21; 29/463

(58) Field of Search ..... 102/318, 482, 102/315, 403, 487, 473; 89/1.13; 29/1.21, 463; 149/19.9, 92

(56) References Cited

U.S. PATENT DOCUMENTS

| | | | | |
|---|---|---|---|---|
| 4,265,177 | * | 5/1981 | Lundborg et al. | 102/275.9 |
| 4,699,063 | * | 10/1987 | Aschwanden et al. | 102/482 |
| 5,654,523 | * | 8/1997 | Brunn | 102/498 |
| 5,845,933 | * | 12/1998 | Walker et al. | 280/741 |
| 5,932,835 | * | 8/1999 | Woodall et al. | 102/403 |
| 5,959,233 | * | 9/1999 | Garcia et al. | 89/1.13 |

* cited by examiner

*Primary Examiner*—J. Woodrow Eldred
(74) *Attorney, Agent, or Firm*—Harvey A. Gilbert; Donald G. Peck

(57) ABSTRACT

Migration of Di-Octyl Adipate (DOA) from PBXN-9 main charge into an adjacent PBXN-5 booster charge is the leading cause for unreliable and inefficient detonations when these two insensitive munition explosives are in close proximity. A hermetic seal of metal foil is interposed between the booster and main charges to block migration of DOA chemicals between the charges. This prevents plasticizing and/or desensitizing the booster charge and possible catastrophic accidental detonations or highly undesirable explosive desensitization which might create unexploded ordnance. The hermetic seal may also have a first portion of metal foil covering the surface of a bore in the booster charge and second portions of metal foil covering the surface of bores in the main charge. The first portion is thinner than the second portions and may be varied in thickness to change the amount and timing of the explosive stimulation of the main charge by the booster charge or to change the detonation signature propagated to the booster charge and main charge.

25 Claims, 5 Drawing Sheets

INSENSITIVE MUNITION BOOSTER SEAL

CROSS REFERENCE TO RELATED APPLICATIONS

This is a continuation in part of copending U. S. patent applications entitled "Reliable and Effective Line Charge System" by Felipe Garcia et al., U.S. Patent and Trademark Office Ser. No. 09/012,932 (NC 78,433), filed Jan. 24, 1998 pending, "Line Charge Insensitive Munition Warhead" by Felipe Garcia et al., U.S. Patent and Trademark Office Ser. No. 08/944,049 (NC 78,448), filed Sep. 12, 1997 now U.S. Pat. No. 5,932,835, "Line Charge Connector" by Felipe Garcia et al., U.S. Patent and Trademark Office Ser. No. 09/030,518 (NC 78,635), filed Feb. 23, 1998 now abandoned, "Line Charge Fastener and Detonating Cord Guide" by Felipe Garcia et al., U.S. Patent and Trademark Office Ser. No. 09/034,772 (NC 78,878), filed Mar. 2, 1998 now U.S. Pat. No. 5,959,233, and "Energy Damper and Recoil Limiting System for Line Charge" by Felipe Garcia et al., U.S. Patent and Trademark Office Ser. No. 09/146,918 (NC 78,958), filed Aug. 31, 1998 pending, and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to munitions deployed in line charges. In particular, this invention relates to metal foil hermetic seals preventing migration of highly mobile plasticizers or desensitizers from one explosive compound to another.

For some time, anti-personnel obstacles and mines have been cleared with an ordnance system called the Bangalore Torpedo MI A2. However, bangalore torpedoes that can clear 0.6 by 45-meter paths are heavy and bulky, 530 pound weapon systems. Another drawback is that as many as a full platoon is needed to deploy them while being exposed to enemy fire for extended periods of time at the side of the obstructed area.

Due to these limitations, the Anti-Personnel Obstacle Breaching System (APOBS) was developed. APOBS is an explosive line charge system that is backpack-portable by two men and rocket-propelled over the obstructed area. Upon launch by rocket, an explosive line charge of grenades flies over and drops on the anti-personnel mines and other obstacles, and fuzing in the system initiates an explosive detonating cord. The detonating cord extends through the center of each insensitive munition warhead (grenade) and initiates the booster in each grenade to detonate each main charge and clear a safe path. Salient features of APOBS are disclosed in the above identified patent applications, and in particular, the application entitled, "Reliable and Effective Line Charge System." The grenade is disclosed in detail in the above identified patent application entitled, "Line Charge Insensitive Munition Warhead." Thus, in accordance with this invention, a need has been recognized in the state of the art to further improve reliability and efficiency of detonation of grenades in a line charge.

SUMMARY OF THE INVENTION

The present invention is directed to providing method and apparatus to hermetically seal munitions. Metal foil seal is interposed between booster and main charges to prevent migration of chemicals that might otherwise affect detonation.

An object of the invention is to provide a metal foil hermetic seal between munitions.

Another object of the invention is to provide a metal foil seal that blocks migration of chemicals between munitions.

Another object of the invention is to provide a seal made of metal foil that separates a booster charge from a main charge to prevent migration of chemicals between them.

Another object of the invention is to provide a seal made of aluminum foil between a booster and main charge to block migration of chemicals between them.

Another object of the invention is to provide a metal foil seal between a booster charge and main charge that does not introduce a barrier that hinders reliability between detonating cord and booster.

Another object of the invention is to provide a metal foil seal that stops chemical migration and prevents explosive transfer from detonating cord to main charge and ensures explosive transfer from detonating cord to booster charge.

Another object of the invention is to provide a metal foil seal between a booster charge and main charge that stops chemical migration and acts as a heat sink to reduce the probability of localized transient hot spots on or around the booster.

Another object of the invention is to provide a metal foil seal between a booster charge and main charge that stops chemical migration and prevents contamination of the booster during fabrication, storage, and handling.

Another object of the invention is to provide a metal foil seal between a booster and main charge that stops chemical migration and increases the reliability of detonation of the main charge by providing higher-density, fast-moving, hot particles.

Another object of the invention is to provide a metal foil seal between a booster and main charge that stops chemical migration and eliminates need of polymeric sealants, such as RTV, to simplify the assembly process.

Another object of the invention is to provide a metal foil seal that prevents chemical migration between energetic materials, such as explosives, propellants, and pyrotechnics, to prevent contaminations which might cause catastrophic accidental detonations or desensitizations of explosives.

Another object of the invention is to provide a metal foil seal between a booster and main charge that stops chemical migration of highly mobile plasticizers and/or desensitizers, such as Di-Octyl Adipate contained in the insensitive munition PBXN-9, into adjacent energetic materials.

Another object of the invention is to provide a grenade having thinner metal foil on the tube under the booster charge and, in comparison, thicker metal foil on the tube under the main charge to change the amount of explosive stimulation for the main charge.

Another object of the invention is to provide a grenade having thinner metal foil on the tube under the booster charge and, by comparison, thicker metal foil on the tube under the main charge to change the timing of the explosive stimulation for the main charge.

Another object of the invention is to provide a grenade having thinner metal foil on the tube under the booster charge and, by comparison, thicker metal foil on the tube under the main charge to vary the amount of explosive stimulation and the timing of the explosive stimulation for the main charge.

Another object of the invention is to provide a grenade having thinner metal foil on the tube under the booster charge and thicker metal foil on the tube under the main charge to vary the detonation signature propagated to the booster charge and main charge.

These and other objects of the invention will become more readily apparent from the ensuing specification when taken in conjunction with the appended claims.

DESCRIPTION OF THE PREFERRED EMBODIMENTS

Figure 1:
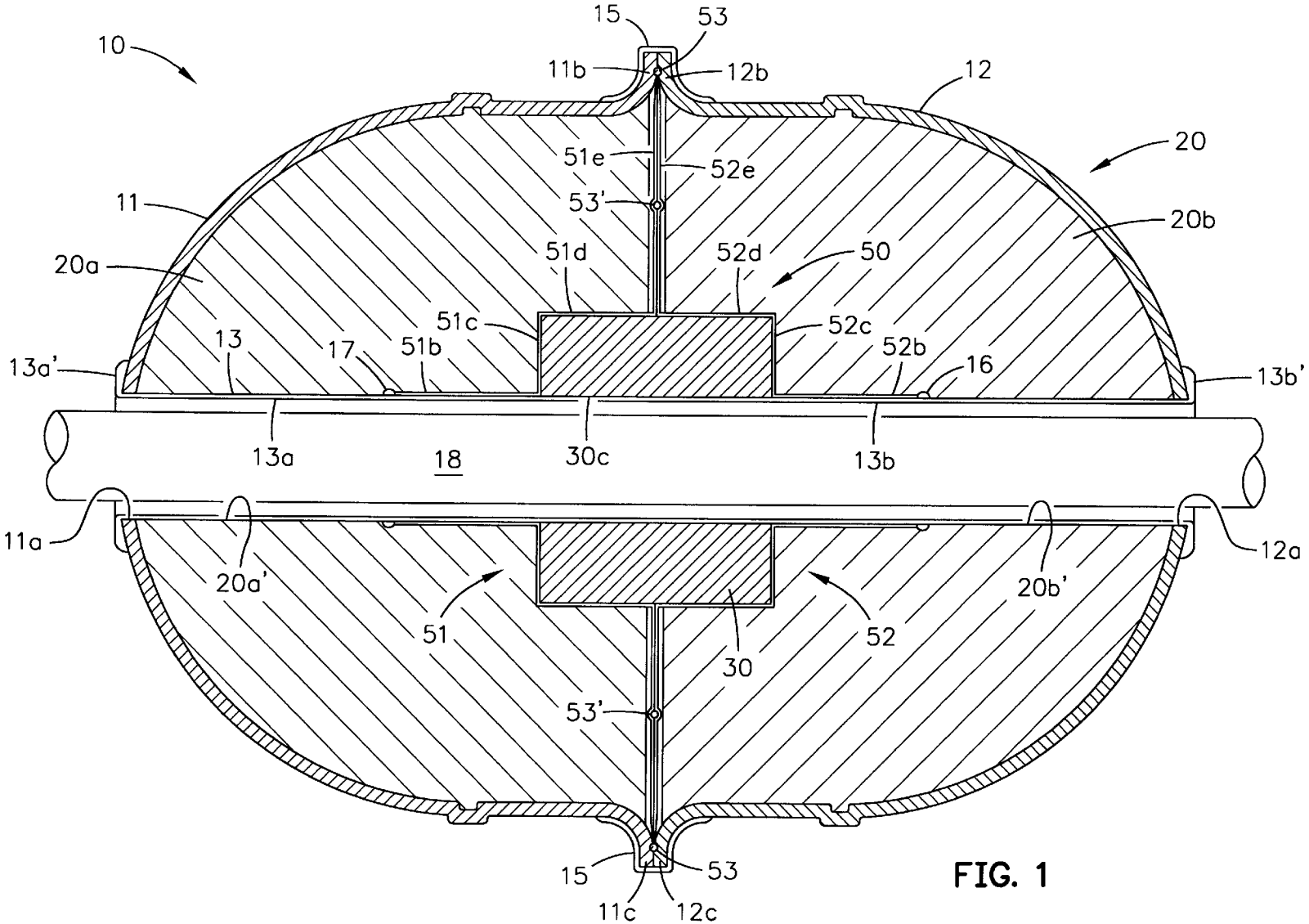
FIG. 1 is a cross-sectional schematic side view of a grenade having a metal foil seal according to this invention.

Referring to FIG. 1, during testing of APOBS, some grenades, or warheads 10 became insensitive (unreliable) to high order detonation after extreme temperature cycling over long periods of time. This was due to migration of the chemical compound Di-Octyl Adipate (DOA) from main charge 20 of PBXN-9 explosive into the tubularly-shaped, or ring-shaped booster charge 30 of PBXN-5 explosive. This migration of DOA was found to be the leading cause for unreliable and inefficient detonations when these two insensitive-munition explosives were placed in close proximity. The migrated DOA had desensitized the PBXN-5 explosive to the extent that low order detonations caused unacceptable mine and obstacle clearance.

Grenade, or warhead 10 may be made from a pair of steel alloy shells 11 and 12. Each shell 11 or 12 has a longitudinal hole, or opening lla or 12*a* at one end and a rim 11*b* or 12*b* with lips 11*c* or 12*c* at its opposite end. Shells are positioned so that rims 11*b*, 12*b* and lips 11*c*, 12*c* abut one another, and openings 11*a* and 12*a* are longitudinally aligned in grenade 10.

Main charge 20 has two halves 20*a* and 20*b* of PBXN-9 that are mirror-images of each other and are press-fitted or preformed in shells 11 and 12, respectively. Halves 20*a* and 20*b* have cylindrically-shaped recesses to receive ring-shaped booster charge 30. Center tube 13 has portions 13*a* and 13*b* extending through bores 20*a*' and 20*b*' of halves 20*a* and 20*b* and through bore 30*c* of booster charge 30. End portions 13*a*' and 13*b*' of tube 13 extend through openings 11*a* and 12*a* and are roll-crimped outwardly in a smooth radius to secure shells 11 and 12 together. Tube 13 may be made from 0.015 inches thick 6061-T6 Aluminum.

An annular strip, or clamp ring 15 encircles shells 11 and about lips 11*c* and 12*c*. Clamp ring 15 is fabricated from steel sheet, and when clamp ring 15 is inwardly roll-crimped about lips 11*c* and 12*c*, shells 11 and 12 further are secured together to define chamber 14 that contains halves 20*a* and 20*b* of main charge 20 and booster charge 30 and tube 13.

The explosives PBXN-5 and PBXN-9 were used in booster charge 30 and main charge 20 of grenades 10 in APOBS to create effective line charges and to assure safety for deploying personnel. PBXN-5 and PBXN-9 met the insensitive munitions requirements of NAVSEA INST 8010.5A "Technical Requirements for Insensitive Munitions." The requirements with references to other documented materials are listed in this instruction. Briefly, insensitive munitions reliably fulfill their performance, readiness, and operational requirements on demand, but are designed to minimize the violence of reaction and subsequent collateral damage when subjected to unplanned stimuli, such as heat, shock, fragment or bullet impact, electromagnetic pulse (EMP), or other unplanned stimuli. Insensitive munitions must meet tests for slow cook-off, fast cook-off, EMP, multiple bullet impact, and multiple fragmentation impact that produce no reaction more severe than burning and must have no sympathetic detonation within predetermined ranges of temperature and humidity, temperature cycling, drop, and vibration in a stowage configuration.

Booster seal 50 is metal foil that seals tubularly-shaped booster charge 30 from main charge 20. This provides a safe, simple, highly reliable, and cost-effective way of preventing migration of highly mobile plasticizers and desensitizers (like DOA) between adjacent energetic materials. Plasticizers and desensitizers create physical and chemical reactions that relax the structures of compounds that have crystal-grain and chains-of-polymer compositions. This increases the energy levels needed to undergo exothermic reactions, such as those characterized by detonation. In other words, when plasticizers and desensitizers affect such a compound, greater stimulation from an exploding detonation cord or other source of initiation may be needed. Thus, chemical migration of such plasticizers and desensitizers between energetic materials (explosives, propellants, and pyrotechnics) is highly undesirable because contaminants are known to cause catastrophic accidental detonations or highly undesirable explosive desensitization which will lead to the problems associated with unexploded ordnance. Because DOA is a highly mobile and effective plasticizer, polymeric barriers between booster and main charges 30 and 20 were found to be useless.

Figure 2:
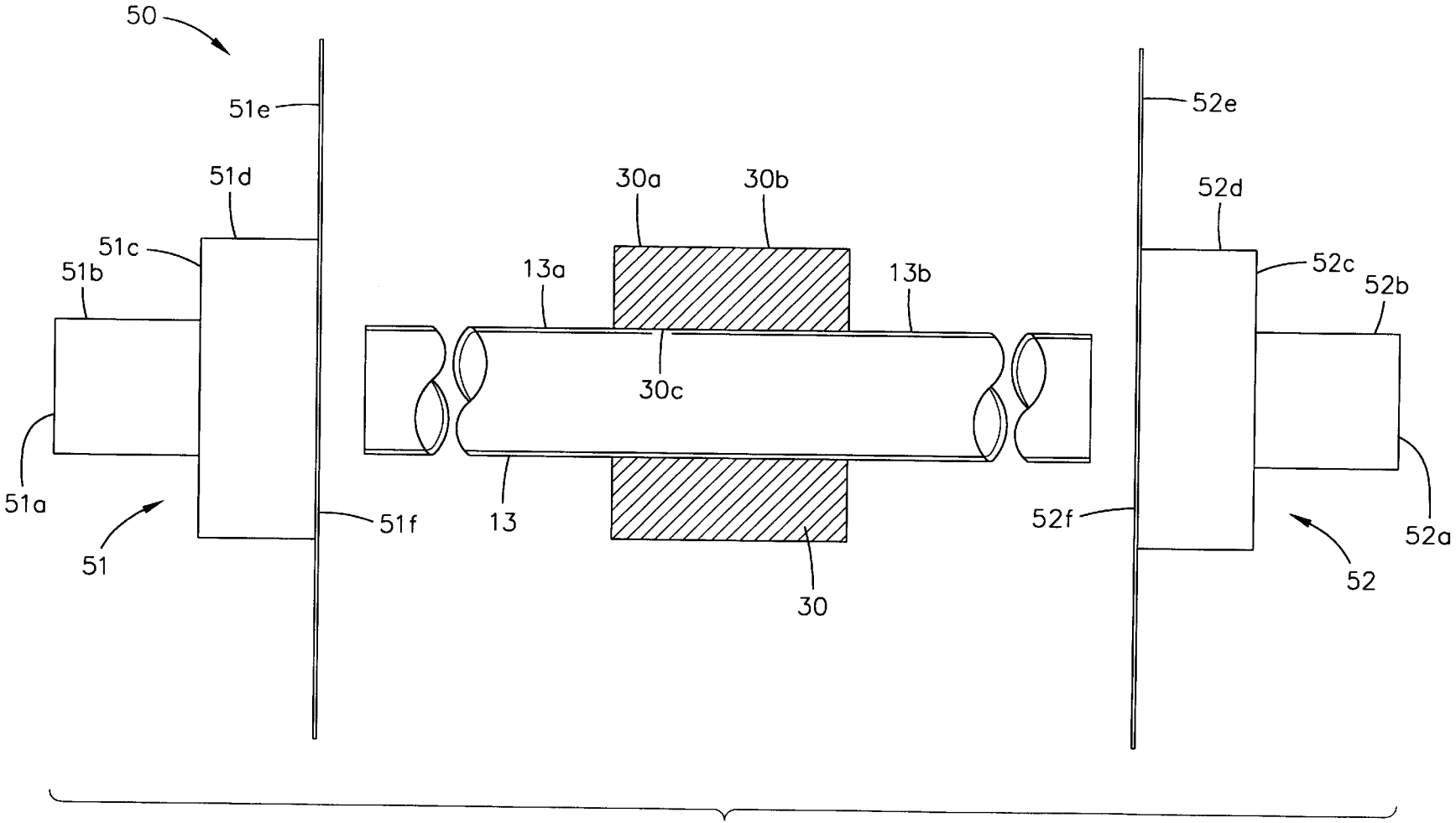
FIG. 2 is a cross-sectional schematic side view showing separated halves of the metal foil seal and booster charge on the tube according to this invention.
Figure 3:
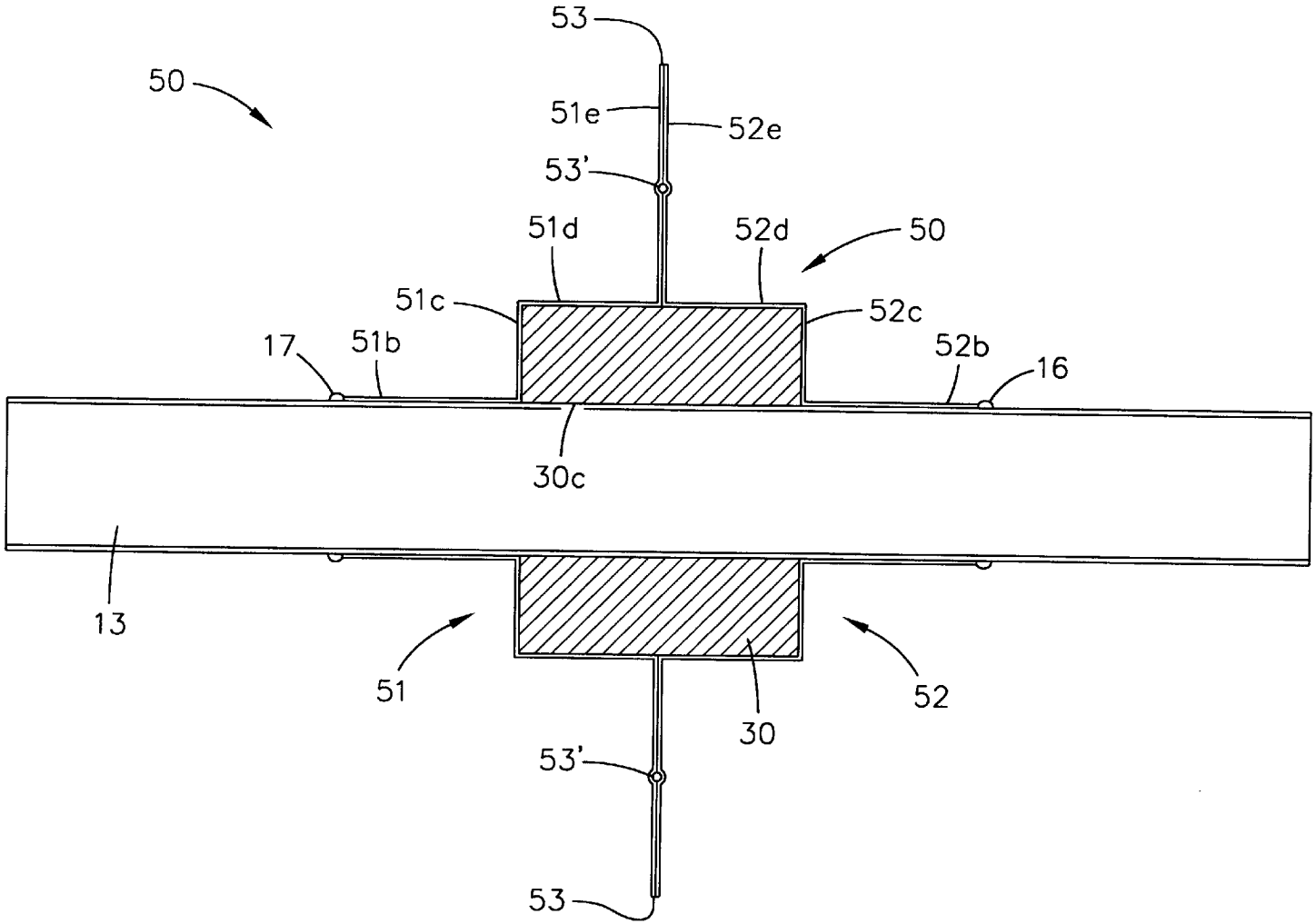
FIG. 3 is a cross-sectional schematic side view of the metal foil halves welded together and to the tube.

Referring to FIGS. 1, 2, and 3, booster seal 50 of this invention is an encapsulation jacket fabricated from metal foil to stop any migration of DOA from main charge 20 of PBXN-9 to booster charge 30 of PBXN-5. Booster seal 50 solves this problem without introducing a barrier that hinders reliability of detonation between detonating cord 18, which longitudinally extends through center tube 13, and booster charge 30.

Booster seal 50 includes two identical metal foil halves 51 and 52. Aluminum 6061 between 0.003 and 0.005 inches thick may be used for metal foil halves 51 and 52, although other metal foils and thicknesses might be used. Metal foil halves 51 and 52 are fitted around, or otherwise formed to accommodate booster charge 30 and center tube 13 to define several portions. Metal foil half 51 has opening 51*a*, tubularly-shaped portion 51*b*, disc-shaped portion 51*c*, tubularly-shaped portion 51*d*, larger diameter flanged end portion 51*e* and opening 51*f*. Metal foil half 52 has opening 52*a*, tubularly-shaped portion 52*b*, disc-shaped portion 52*c*, tubularly-shaped portion 52*d*, larger diameter flanged end portion 52*e*, and opening 52*f*.

Center tube 13 fits in bore 30*c* and extends through booster charge 30 and through openings 51*a* & 51*f* and 52*a* & 52*f* of foil halves 51 and 52. Portions 51*d* & 51*c* and 52*d* & 52*c* of foil halves 51 and 52 conform to outer surfaces 30*a* and 30*b* on adjacent halves of booster charge 30, and tubular portions 51*b* and 52*b* conform to at least part of the lengths of oppositely extending parts 13*a* and 13*b* of center tube 13. Larger diameter, flanged end portions 51*e* and 52*e* extend radially outwardly from the ends of portions 51*d* and 52*d* of foil halves 51 and 52.

Referring to FIG. 3, after metal foil halves 51 and 52 are on the outer surfaces of booster charge 30 and at least part of parts 13*a* and 13*b* of center tube 13, booster 30 is ready to be sealed. Portions 51*b* and 52*b* are ultrasonically welded to parts 13*a* and 13*b* in annular welds 16 and 17 which seal foil halves 51 and 52 to center tube 13. Annular welds 16 and 17 may be at the ends of portions 51*b* and 52*b* or somewhere along their lengths. Larger diameter flanged end portions 51*e* and 52*e* are ultrasonically welded together in annular weld 53 that continuously extends along their circumferences where they contact each other. Optionally, larger diameter flanged end portions 51*e* and 52*e* could be welded together by annular weld 53' that continuously extends all the way around at a distance about halfway to their circumferences. Once foil halves 51 and 52 are welded to each other and to center tube 13, booster charge 30 is sealed hermetically.

Bores 20*a*' and 20*b*' in halves 20*a* and 20*b* of main charge 20 are slid over parts 13*a* and 13*b* of center tube 13 and portions 51*b* and 52*b* of metal foil seal 50. Larger diameter flanged end portions 51*e* and 52*e* are sandwiched between the ends of halves 20*a* and 20*b*. End portions 13*a*' and 13*b*' of center tube 13 extend through openings 11*a* and 12*a* in shells 11 and 12 and are roll crimped outwardly to bear against the outside of the shells around the openings. Shells 11 and 12 of grenade 10 are securely fastened together by crimping, or otherwise tightening and securing metal ring 15 on lips 11*c* and 12*c*. Crimped ring 15 thereby creates a supplementary seal along this crimped juncture for annular weld 53 or 53'. In addition, clamp ring 15 functions as a heat sink joined to flanged end portions 51*e* and 52*e* of metal foil halves 51 and 52.

Figure 4:
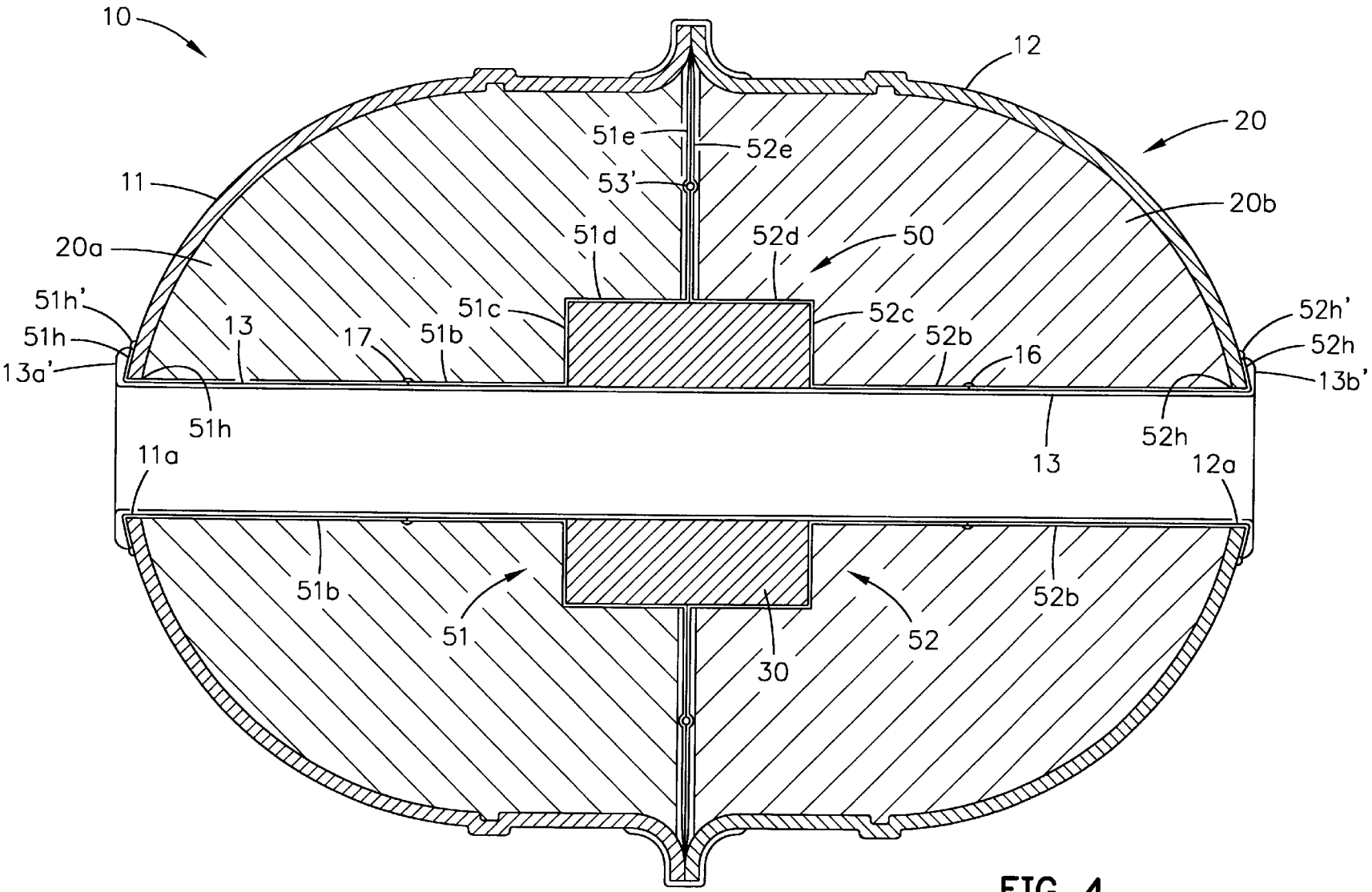
FIG. 4 is a cross-sectional schematic side view of a grenade showing the metal foil halves extending to the ends of the tube and crimped by the crimped ends of the tube.

Referring to FIG. 4, metal foil half 51 also may have extension on portion 51*b* that extends to, or slightly beyond end portion 13*a*' of tube 13, and metal foil half 52 also may have extension 52*h* on portion 52*b* that extends to, or slightly beyond end portion 13*b*' of tube 13. Extension 51*h* contiguously abuts roll-crimped end portion 13*a*' and is roll-crimped with it to form a sealing lip that is supplementary to annular weld 17. Extension 52*h* contiguously abuts roll-crimped end portion 13*b*' and is roll-crimped with it to form a sealing lip that is supplementary to annular weld 16. Furthermore, extensions 51*h* and 52*h* also act as heat sinks to reduce the probability of damaging, localized transient hot spots on or around PBXN-5 booster charge 30. These hot spots might be caused by external stimuli like bullet or fragment impacts or transient thermal events like fast cook-off. This feature may improve survivability in combat.

Figure 5:
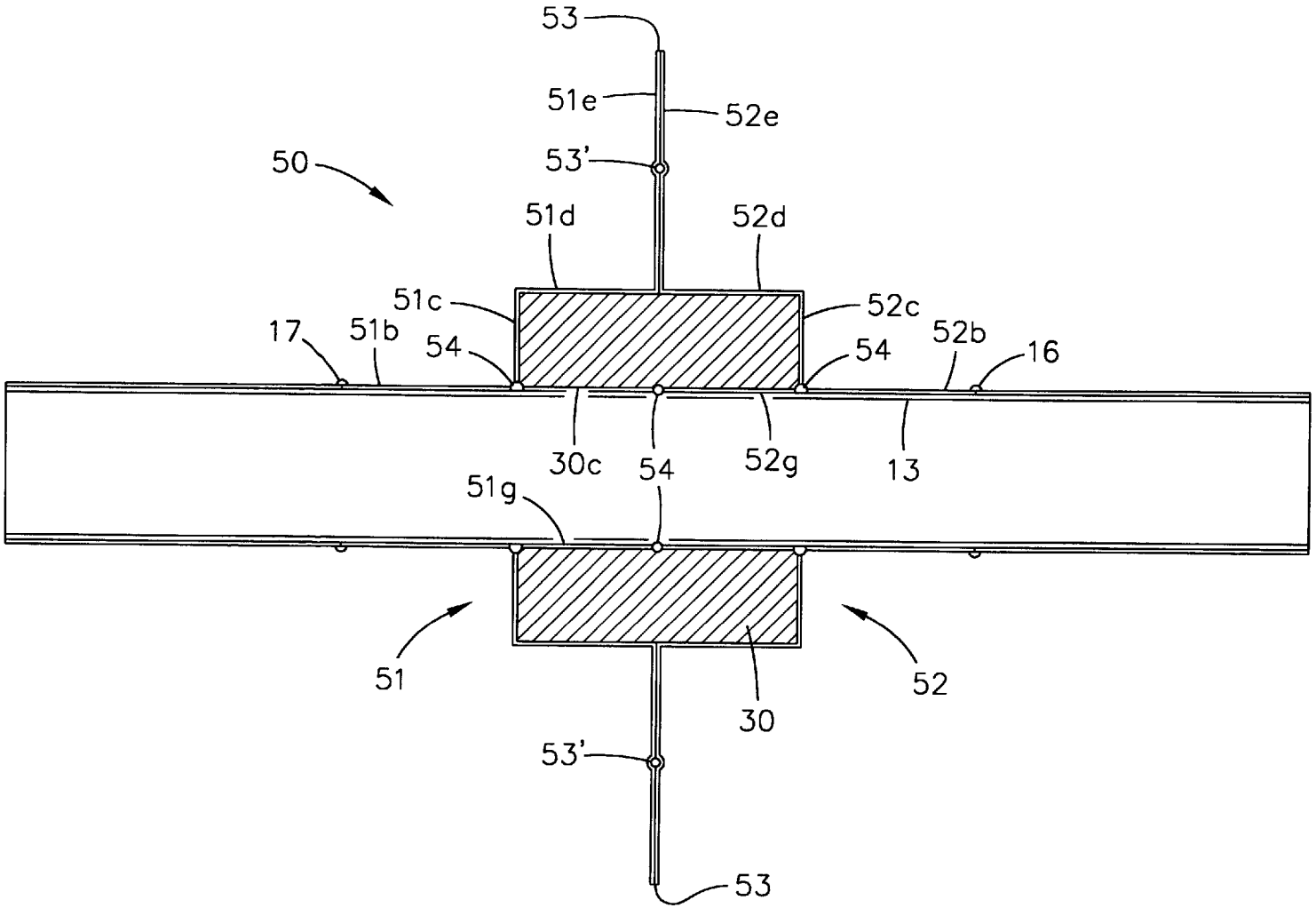
FIG. 5 is a cross-sectional schematic side view of a grenade having thinner metal foil on the tube under the booster charge and thicker metal foil on the tube under the main charge.

Referring to FIG. 5, hermetic seal 50 may also have thicker or thinner portions of metal foil 50 as desired by using common commercial practices like stamping, drawing, spinning, welding, or mechanical adhesion. Metal foil halves 51 and 52 may be made to extend to the opposite ends of tube 13 and be made thicker along portions 51*b* and 52*b* to preclude explosive transfer into PBXN-9 main charge 20 from detonating cord 18. Metal foil halves 51 and 52 may be further modified to have additional inner portions 51*g* and 52*g* that contiguously abut the surface of bore 30*c* inside of PBXN-5 booster charge 30. Metal foil in inner portions 51*g* and 52*g* can be made thinner in booster charge 30, as compared to thicker metal foil in portions 51*b* and 52*b*, to ensure explosive transfer to booster charge 30 from detonating cord 18. Annular welds 54 would be provided in this modification to seal the connections of portions 51*g* and 52*g*.

Thinner metal foil in portions 51*g* and 52*g* next to tube 13 under booster charge 30 and by comparison, thicker metal foil thicker along portions 51*b* and 52*b* on tube 13 all the way under main charge 20 provides the capability to vary both the timing and amount of the explosive stimulation provided by detonating cord 18. The relatively thicker metal of portion 51*b* and 52*b* prevents detonating cord 18 from affecting main charge 20 directly. However, as the relatively thinner metal foil of 51*g* and 52*g* is made thicker (but less than the thickness of portions 51*b* and 52*b*) detonation transfer from detonating cord 18 to booster charge 30 is slowed down and is less severe.

Grenades made in accordance with this feature will have hermetic seals with a first portion 51*g*–52*g* of metal foil covering the surface of the bore of booster charge 30 and second portions of metal foil covering the surfaces 51*b*–52*b* of bores in main charge 20. The first portion is thinner than the second portions. Portion 51*g*–52*g* of metal foil is made thinner to increase and thicker to decrease the amount of explosive stimulation of said booster charge 30 by detonating cord 18 extending through tube 13. Portion 51*g*–52*g* of metal foil is made thinner to increase and thicker to decrease the timing of the explosive stimulation of booster charge 30 by detonating cord 18. Consequently, portion 51*g*–52*g* of metal foil is made thinner to increase and thicker to decrease the amount of explosive stimulation of main charge 20 by booster charge 30, the timing of explosive stimulation of main charge 20 by booster charge 30 and to change the detonation signature propagated to booster charge 30 and main charge 20.

Therefore, munitions designers and detonating teams have great flexibility to control not only the detonation sequence, but also the severity, vigor, and type of detonation to be effected by main charges 20. Detonation of line charges and other serial or parallel coupled systems of main charges can be reliably and effectively controlled to generate precise explosive detonation sequences. These precise explosive detonation sequences have specific detonation signatures that are a function of the different thicknesses of metal foils 51*g* and 52*g* in the individual charges.

Thin metal foil seal 50 which surrounds PBXN-5 booster charge 30 also may increase the reliability of transferring detonation to PBXN-9 main charge 20. This is because additional higher-density fast-moving hot particles of molten foil are created and impelled by exploding PBXN-5 booster charge 30 into PBXN-9 main charge 20.

Since PBXN-5 booster charge 30 is hermetically sealed by metal foil 50, inadvertent explosive contamination is precluded either into or from PBXN-5 booster charge 30 at a very high confidence level. This feature is important since it allows contamination-free handling of PBXN-5 during fabrication and subsequent storage of booster charge 30 prior to installation into grenade 10. Furthermore, since PBXN-5 booster charge 30 is hermetically sealed in metal foil 50, the need of RTV or other sealants is eliminated to simplify the assembly process. The hermetically sealed PBXN-5 booster charge permits a simplification of demilitarization processes when recycling methods are used in accordance with environmental, safety and health requirements.

Optionally, sealing of booster charge 30 could dispense with annular welds 16 and 17 and rely on the seals provided by crimping ends 13*a*' and 13*b*' of tube 13 against shells 11 and 12, which also crimps ends of foil extensions 51*h* and 52*h*. Thus, sealing could be completed in one final step during the crimping of the opposite ends of tube 13. In addition, metal foil extensions 51*h* and 52*h* also may be welded to tube 13 in annular welds 51*h*' and 52*h*' where they might extend beyond crimped ends 13*a*' and 13*b*' of tube 13, see FIG. 4.

Insensitive munition booster seal 50 of this invention is a simple, yet effective modification of the existing grenade used in line charges. It helps assure reliability and complete detonation. When used in conjunction with the insensitive munition PBXN-8 of detonating cord 18, metal foil seal 50 also allows the design, fabrication, and transport of ready-to-be-detonated highly energetic systems that meet the insensitive munition requirements of MIL-STD-2105. As a result, explosive systems using these features are safer and more cost-effective.

This inventive concept additionally embraces the process of hermetically sealing an explosive charge. A metal tube 13 is extended through traverse bore 30*c* of explosive booster 30. First metal foil 51 is shaped to conform to outer contours of one portion of booster charge 30 and first part 13*a* of tube 13. Second metal foil 52 is shaped to conform to outer contours of another portion of booster 30 and a second part 13*b* of tube 13. First and second parts 13*a* and 13*b* of tube 13 are on opposite sides of booster 30. First and second metal foils 51 and 52 abut radially outwardly from booster 30 and the abutting portions are sealed, or welded together in a continuous weld. First metal foil 51 is welded to first part 13*a* of tube 13, and second metal foil 52 is welded to the second part 13*b* by separate continuous welds to hermetically seal booster 30 therein. First metal foil and second metal foil 51 and 52 are shaped to conform to substantially all of the outer surface contours of booster charge 30. End 13*a*' of the first part 13*a* of tube 13 is extended through an opening in shell 11, and end 13*b*' of second part 13*b* of tube 13 is extended through an opening in shell 12. Both shells may contain booster charge 30 as well as main charge 20, if desired. Ends 13*a*' and 13*b*' are crimped to shells 11 and 12 to secure them together. Crimping ends 13*a*' and 13*b*' may also seal booster charge 30 from main charge 20. Extending extension 51*h* of portion 51*b* of metal foil 51 over end 13*a*' of part 13*a* of tube 13, and extending extension 52*h* of portion 52*b* of metal foil 52 over end 13*b*' of part 13*b* of tube 13 assures that extensions 51*h* and 52*h* will be crimped when ends 13*a*' and 13*b*' are crimped to provide supplementary seals for continuous welds on tube 13.

Accordingly, having this disclosure in mind, one skilled in the art to which this invention pertains will select and assemble various components with various assembly techniques from among a wide variety available in the art. For example, this invention could be adapted to applications other than the grenades used in the deployment of line charges. The invention could find applications wherever explosive charges or other chemical compounds could be contaminated by plasticizers or desensitizers from adjacent sources. Since polymeric barriers are useless with such highly mobile and effective plasticizers, metal foil seal 50 of this invention can be used successfully in a host of diverse applications. Therefore, this disclosure is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A hermetic seal of metal foil interposed between a booster charge and main charge to block migration of chemicals therebetween, said metal foil being shaped to contiguously conform to outer surfaces of said booster charge and having welds to seal said booster charge from said main charge.

2. A hermetic seal according to claim 1 in which said metal foil includes two identically shaped halves each shaped to conform to one-half of said outer surfaces and said halves are welded together in an annular seam along a circumferential rim where they abut one another.

3. A hermetic seal according to claim 2 in which said booster charge has a longitudinal bore having a tube extending therethrough, and each of said halves is welded in an annular weld to said tube where it extends from opposite ends of said booster charge.

4. A hermetic seal according to claim 3 in which said metal foil includes aluminum.

5. A grenade according to claim 1 in which said hermetic seal further includes a first portion of metal foil covering the surface of a bore in said booster charge and second portions of metal foil covering the surface of bores in said main charge, and said first portion is thinner than said second portions.

6. A grenade according to claim 5 in which said first portion of metal foil has a variable thickness. said thickness of said first portion of metal foil being thinner to increase and thicker to decrease the amount of explosive stimulation of said booster charge by a detonating cord extending through a tube extending through said bore in said booster charge.

7. A grenade according to claim 6 in which said first portion of metal foil has a variable thickness. said thickness of said first portion of metal foil being thinner to increase and thicker to decrease the timing of the explosive stimulation of said booster charge by said detonating cord.

8. A grenade according to claim 5 in which said first portion of metal foil has a variable thickness, said thickness of said first portion of metal foil being thinner to increase and thicker to decrease the amount and timing of the explosive stimulation of said main charge by said booster charge.

9. A grenade according to claim 5 in which said first portion of metal foil has a variable thickness, said thickness of said first portion of metal foil being thinner and thicker to change the detonation signature propagated to said booster charge and said main charge.

10. A method of hermetically sealing an explosive charge comprising the steps of:

extending a metal tube through a traverse bore in an explosive charge;

shaping first metal foil to conform to outer contours of one portion of said explosive charge and first part of said tube;

forming a second metal foil to conform to outer contours of another portion of said explosive charge and second part of said tube, said first and second parts being on opposite sides of said explosive charge;

abutting portions of said first and second metal foils radially outwardly from said explosive charge; and welding by separate continuous welds said abutting portions together, said first metal foil sheet to said first part, and said second metal foil sheet to said second part thereby hermetically sealing said explosive therein.

11. A method according to claim 10 in which said step of shaping said first metal foil and shaping said second metal foil conforms said foils to substantially all of the outer surface contours of said explosive charge.

12. A method according to claim 11 further including the steps of:

extending an end of said first part of said tube through an opening in a first shell and an end of said second part of said tube through an opening in a second shell, said shells containing said explosive charge and a main charge; and crimping said ends of said first and second parts of said tube to said shells to secure said shells together.

13. A method according to claim 12 in further including the step of:

extending an end portion of said first metal foil to extend over said end of said first part of said tube; and extending an end portion of said second metal foil to extend over said end of said second part of said tube, said step of crimping said ends also crimping said end portions of said first and second metal foils onto said shells to provide supplementary seals for said continuous welds.

14. A method according to claim 12 in further including the step of:

providing a third portion of metal foil to cover the surface of a bore in said booster charge; and providing said end portions of metal foil to cover the surface of bores in said main charge, said third portion being thinner than said end portions.

15. An improved grenade comprising:

a pair of shells, each having a radially extending annular lip at one end and an opening at the other end, said lips of said shells abutting one another to define a chamber and to axially align said openings;

a fastener adjacent said lips to hold said shells together;

a main charge and booster charge of explosives in said chamber, said main and booster charges having bores aligned with each other and said openings;

a tube extending through said openings and bores having portions at opposite ends engaging said shells to hold them together along said lips; and a hermetic seal of metal foil interposed between said booster charge and said main charge to block migration of chemicals therebetween.

16. A grenade according to claim 15 in which said fastener is an annular strip inwardly roll-crimped to hold said radially extending lips together, and said end portions of said tube are outwardly roll-crimped to engage said shells.

17. A grenade according to claim 16 in which said hermetic seal of metal foil includes two foil halves welded to each other in an annular weld and to said tube in two annular welds to seal said booster charge from said main charge.

18. A grenade according to claim 17 in which said roll-crimped annular strip and said roll-crimped end portions engage said two foil halves to further seal said booster charge from said main charge.

19. A grenade according to claim 15 in which said hermetic seal further includes a first portion of metal foil covering the surface of said bore of said booster charge and second portions of metal foil covering the surface of said bore of said main charge, said first portion is thinner than said second portions.

20. A grenade according to claim 19 in which said first portion of metal foil has a variable thickness. said thickness of said first portion of metal foil being thinner to increase and thicker to decrease the amount of explosive stimulation of said booster charge by a detonating cord extending through said tube.

21. A grenade according to claim 20 in which said first portion of metal foil has a variable thickness, said thickness of said first portion of metal foil being thinner to increase and thicker to decrease the timing of the explosive stimulation of said booster charge by said detonating cord.

22. A grenade according to claim 20 in which said first portion of metal foil has a variable thickness. said thickness of said first portion of metal foil being thinner to increase and thicker to decrease the amount of explosive stimulation of said main charge by said booster charge.

23. A grenade according to claim 21 in which said first portion of metal foil has a variable thickness. said thickness of said first portion of metal foil being thinner to increase and thicker to decrease the timing of the explosive stimulation of said main charge by said booster charge.

24. A grenade according to claim 19 in which said first portion of metal foil has a variable thickness. said thickness of said first portion of metal foil being thinner to increase and thicker to decrease the amount and timing of the explosive stimulation of said main charge by said booster charge.

25. A grenade according to claim 19 in which said first portion of metal foil has a variable thickness. said thickness of said first portion of metal foil being thinner and thicker to change the detonation signature propagated to said booster charge and said main charge.

* * * * *